US005465846A

United States Patent [19]

Blyth et al.

[11] Patent Number: 5,465,846

[45] Date of Patent: Nov. 14, 1995

[54] BAG DISPENSING SYSTEM

[75] Inventors: David Blyth; David Granovsky, both of Toronto; Greg Ledger; Bruce Smith, both of Scarborough, all of Canada

[73] Assignee: Atlantic Packaging Products Ltd., Scarborough, Canada

[21] Appl. No.: 207,462

[22] Filed: Mar. 8, 1994

[51] Int. Cl.[6] ..... B65D 1/34

[52] U.S. Cl. ..... 206/554; 383/9

[58] Field of Search ..... 206/554; 383/8, 383/9, 37

[56] References Cited

U.S. PATENT DOCUMENTS

| | | | |
|---|---|---|---|
| Re. 33,264 | 7/1990 | Baxley et al. | 206/554 |
| Re. 34,019 | 8/1992 | Kuklies et al. | 383/8 |
| 3,184,055 | 5/1965 | Davis et al. | 206/554 |
| 3,380,579 | 4/1968 | Pinto | 206/57 |
| 3,552,697 | 1/1971 | Pinto | 248/97 |
| 3,747,298 | 7/1973 | Lieberman | 53/390 |
| 3,915,302 | 10/1975 | Farrelly et al. | 206/460 |
| 4,106,733 | 8/1978 | Walitalo | 248/100 |
| 4,106,734 | 8/1978 | Walitalo | 248/100 |
| 4,529,090 | 7/1985 | Pilon | 206/554 |
| 4,560,067 | 12/1985 | Reimann | 206/554 |
| 4,562,925 | 1/1986 | Pistner | 206/554 |
| 4,613,988 | 9/1986 | Maddock | 383/8 |
| 4,759,639 | 7/1988 | Dematteis | 383/7 |
| 4,785,938 | 11/1988 | Benoit et al. | 206/554 |
| 4,796,759 | 1/1989 | Schisler | 206/554 |
| 4,811,417 | 3/1989 | Prince et al. | 383/9 |
| 4,981,216 | 1/1991 | Wilfong, Jr. | 206/554 |
| 4,989,732 | 2/1991 | Smith | 206/554 |
| 4,995,860 | 2/1991 | Wilfong, Jr. | 493/195 |
| 5,020,750 | 6/1991 | Vrooman et al. | 248/97 |
| 5,074,674 | 12/1991 | Kuklies et al. | 383/8 |
| 5,087,234 | 2/1992 | Prader et al. | 493/194 |
| 5,125,604 | 6/1992 | Vrooman et al. | 248/97 |
| 5,183,158 | 2/1993 | Boyd et al. | 206/554 |
| 5,188,235 | 2/1993 | Peirce et al. | 206/554 |
| 5,207,328 | 5/1993 | Bose et al. | 206/554 |
| 5,269,605 | 12/1993 | Nguyen | 383/9 |
| 5,290,104 | 3/1994 | Sengewald | 383/25 |
| 5,307,935 | 5/1994 | Kemanjian | 206/554 |
| 5,335,788 | 8/1994 | Beasley et al. | 206/554 |
| 5,346,310 | 9/1994 | Nguyen | 206/554 |

FOREIGN PATENT DOCUMENTS

| | | |
|---|---|---|
| 976397 | 10/1975 | Canada . |
| 1061734 | 9/1979 | Canada . |
| 1206449 | 6/1986 | Canada . |
| 1207715 | 6/1986 | Canada . |
| 1229825 | 12/1987 | Canada . |
| 1234787 | 4/1988 | Canada . |
| 1235674 | 4/1988 | Canada . |
| 1237394 | 5/1988 | Canada . |
| 1243001 | 10/1988 | Canada . |
| 1248060 | 1/1989 | Canada . |
| 1251179 | 3/1989 | Canada . |
| 1258051 | 8/1989 | Canada . |
| 1269954 | 6/1990 | Canada . |
| 1272166 | 7/1990 | Canada . |
| 1317258 | 5/1993 | Canada . |

*Primary Examiner*—David T. Fidei

[57] ABSTRACT

A bag dispensing system has numerous thin plastic bags weakly attached together to form a bag pack, and a rack for supporting the bag pack and dispensing individual bags. Each bag has a tear-away release means which includes at least one centrally located opening for receiving a support finger of the rack, and is separated from an upper edge of the bag by a tear through portion. At least one pressure point is located adjacent the tear through portion. Each bag has a pair of opposed handles, each of which includes a flap-free opening for receiving a side support rod of the rack. The bag pack has successive overlying layers of thermoplastic film which form successive outside bag surface to outside bag surface contacts alternating with inside bag surface to inside bag surface contacts. Each layer of the bag pack is weakly joined to both adjacent layers without adhesive. The weak joints between layers are of alternating strengths so that the outside bag surface to outside bag surface weak joint is stronger than the inside bag surface to inside bag surface weak joint.

14 Claims, 4 Drawing Sheets

BAG DISPENSING SYSTEM

FIELD OF THE INVENTION

The present invention relates generally to the field of bag dispensing systems, and in particular relates to thin plastic bags of the type which may be attached together to form a stack or pack, and which are individually dispensed from a rack which supports the bag pack.

BACKGROUND OF THE INVENTION

Bags made of thermoplastic materials are in widespread use in grocery and retail businesses, substantially replacing the use of paper bags. These thermoplastic bags, commonly referred to as "plastic bags" or "t-shirt bags", enjoy several advantages over paper bags, such as their light weight, strength and water resistance. Plastic bags are also compact when laid flat, which allows numerous bags to be stacked one atop another to form bag packs, for ease of handling and shipping.

Systems have been developed to dispense individual bags from a bag pack and to facilitate the handling and loading of the individual bag upon separation from the bag pack. Generally speaking, these systems employs a rack for mounting or propping up a bag pack and for supporting an individual plastic bag separated from the pack, to allow a user to load goods into the separated plastic bag without having to hold it up.

One such system is shown in U.S. Pat. No. Re 33,264 (Baxley et al.), a reissue of U.S. Pat. No. 4,676,378, and assigned to Sonoco Products Company. The rack has two spaced rods for supporting the stacked handles of a back pack, and has a hook element between the two rods for receiving a central detachable mounting tab on the bag pack. The handles of the bags in the bag pack have rod receiving apertures formed by partially severed flaps. The flaps are heat bonded together throughout the full stack to maintain aperture alignment. The patent teaches that rods can sever the aligning flaps when the bag pack is placed onto the rods. If the flaps are not fully severed and only folded down by the rods, then the handles tend to sever from the flaps as individual bags are removed from the bag pack. Likewise, the central mounting tab is severed from each bag as it is removed from the pack. When a bag pack is used up, a clump of mounting tabs is left on the hook element and must be discarded, as well as two clumps of flaps. This creates substantial needless waste, and requires someone to take extra time to remove and dispose of the clump of tabs from the central hook before loading another bag pack onto the rack.

To facilitate the opening and dispensing of consecutive bags in the Baxley system, the rear panel of each bag may be provided with a dab of readily disengageable adhesive. The adhesive bonds the rear panel of a first bag with the front panel of an adjacent second bag. The bond on the rear panel is supposed to draw the front panel of the second bag forwardly as the first bag is removed from the rack, thus severing the front panel from the central mounting tab. The forward movement of the severed front panel of the second bag is stopped by upturned ends on the support arms of the rack. The upturned ends provide a resistive force which is greater than the adhesive's bonding force, thus allowing the bond to be severed as the first bag is removed, leaving the second bag in a fully open loading position.

Another very similar system is shown in U.S. Pat. No. 5,020,750 (Vrooman et al.), also assigned to Sonoco Products Company. This patent makes specific reference to U.S. Pat. No. 4,676,378, noting that successful use of the prior art system requires a user to first practice with it. Certain problems with the manual opening of consecutive bags are also mentioned, specifically where a user breaks both the front and back wall of each consecutive bag from the central mounting tab, proper positioning of the bag in an open loading position on the rack is harder.

To try to overcome these problems, Vrooman teaches that when a loaded first bag is being removed from the rack, the adhesive bond on its rear wall will first pull the front wall of an adjacent second bag outwardly, severing the front wall from the detachable mounting tab because the strength of the adhesive bond is greater than the detachable mounting tab's severance strength. As the first bag continues to move off of the rack, its rear wall pulls the front wall of the next bag forwardly, causing the apertures in the handles of the second bag to slide forwardly on the arms of the rack. The arms include portions of greater resistive force. The rear wall of the first bag then disengages from the front wall of the second bag because the resistive force against sliding along the arms is greater than the adhesive's bond strength.

The Vrooman system suffers from the same disadvantage as the Baxley system, namely a clump of mounting tabs must be collected, removed and discarded when a bag pack is used up.

Another disadvantage of both prior systems is the use of the adhesive between bags. Cashiers and other frequent users of these systems get the adhesive all over their fingers, which is a health risk since it might be ingested, or cause eye problems if rubbed in the eye or the like. This system is also not hygienic since dirt is attracted and adheres to the fingers. The sticky dirty fingers also interfere with the cashier's operation of the cash register, and interferes with the bagging operation as well because the bag material sticks to the fingers.

Yet another drawback of the Vrooman system is the difficulty in removing a loaded bag off of the rack's arms. The holes in the bag's handles do not slide easily over the rubber end portions at the ends of the support arms. The enlarged balls at the ends of the support arms also interfere with removal of the handles. A user must shimmy and repeatedly jerk the handles over the end portions to free the handles from the arms. This is a particularly uncomfortable and, over the course of a few hours, a physically tiring operation for cashiers. Since the racks are often arranged sideways to a cashier (i.e. the rack's arms are oriented parallel to the long axis of the checkout counter), the cashier must perform the shimmying with one arm outstretched to reach the bag handle on the far arm of the rack.

What is desired therefore is a bag dispensing system having a bag pack insertable on a rack which allows a user to automatically and easily set a bag in a position ready for loading after another loaded bag is removed off of the rack. The loading position should be achieved without employing any extra adhesive between the individual bags of a back pack. The rack should not unduly interfere with the removal of a loaded bag off the rack. Further, once all of the bags in a bag pack have been dispensed, there should be no plastic material left over which must be collected and disposed of as trash.

SUMMARY OF THE INVENTION

In one aspect the invention provides a bag pack comprised of a plurality of bags weakly attached together to form a stack, each said bag comprising:

integral front, back and side walls formed from thermoplastic film, said walls being joined along a bottom edge to form a closed bottom on said bag, and said walls having an upper edge which defines an open top, said bag having an inside bag surface and an outside bag surface;

a tear away release means including at least one centrally located support finger receiving opening which is separated from said upper edge by a tear through portion and at least one pressure point located adjacent said tear through portion, and a pair of opposed handles extending upwardly from opposed sides of said open top, each handle having a join line along a top edge and forming a closed loop for lifting said bag, each handle further including a side support rod receiving opening formed on an axis transverse to said closed loop, wherein said bag pack has successive overlying layers of thermoplastic film, forming successive outside bag surface to outside bag surface contacts alternating with inside bag surface to inside bag surface contacts, and each layer of said bag pack is weakly joined to both adjacent layers without adhesive, said weak joints between layers being of alternating strengths wherein said outside bag surface to outside bag surface weak joint is stronger than said inside bag surface to inside bag surface weak joint.

In another aspect of the invention, the invention provides a bag dispensing system comprising:

a bag pack comprised of a plurality of bags weakly attached together to form a stack each said bag comprising integral front, back and side walls formed from thermoplastic film, said walls being joined along a bottom edge to form a closed bottom on said bag, and said walls having an upper edge which defines an open top, said bag having an inside bag surface and an outside bag surface;

a tear away release means including at least one centrally located support finger receiving opening which is separated from said upper edge by a tear through portion and at least one pressure point located adjacent said tear through portion, and a pair of opposed handles extending upwardly from opposed sides of said open top, each handle having a join line along a top edge and forming a closed loop for lifting said bag, each handle further including a side support rod receiving opening formed on an axis transverse to said closed loop, and a rack for supporting said bag pack, said rack including a pair of longer opposed cantilevered side support rods and at least one shorter cantilevered middle support finger, said cantilevered side support rods being of a length to allow one of said bags to be fully supported in an open position, and the shorter cantilevered middle support finger being of a length at least slightly longer than a thickness of said bag pack, wherein a complete bag pack can be mounted over said middle support finger at said middle support receiving opening, wherein said bag pack is in the form of successive layers characterised in that there are successive outside surface to outside surface contacts alternating with inside surface to inside surface contacts and each layer of said bag pack is weakly joined to both adjacent layers, said weak joint being characterised in alternating strengths between successive interfaces, wherein said outside bag surface to outside bag surface weak joint is stronger than said inside bag surface to inside bag surface weak joint.

In yet a further aspect of the invention, the invention provides a method of manufacturing self dispensing bag packs, said method comprising the steps of:

a) forming a tube of thin thermoplastic film having an outside surface and an inside surface;

b) treating said outside surface differently than said inside surface;

c) folding, cutting and stacking said tube into closed bottom bag elements, to form a stack having layers of thermoplastic film, wherein the layers are characterised by having outside surface to outside surface contact alternating with inside surface to inside surface contact;

d) forming an open top with a pair of upstanding handles in each of said closed bottom bag elements in said stack by cutting said stack; and e) forming weak bonds between each of said layers of thermoplastic film in said stack, wherein said weak bonds between said inside to inside surface contacts are not as strong as said weak bonds between said outside to outside surface contacts.

DESCRIPTION OF THE DRAWINGS

A preferred embodiment of the invention will now be described, by way of example, with reference to the accompanying drawings, wherein.

DESCRIPTION OF THE PREFERRED EMBODIMENT

Figure 3:
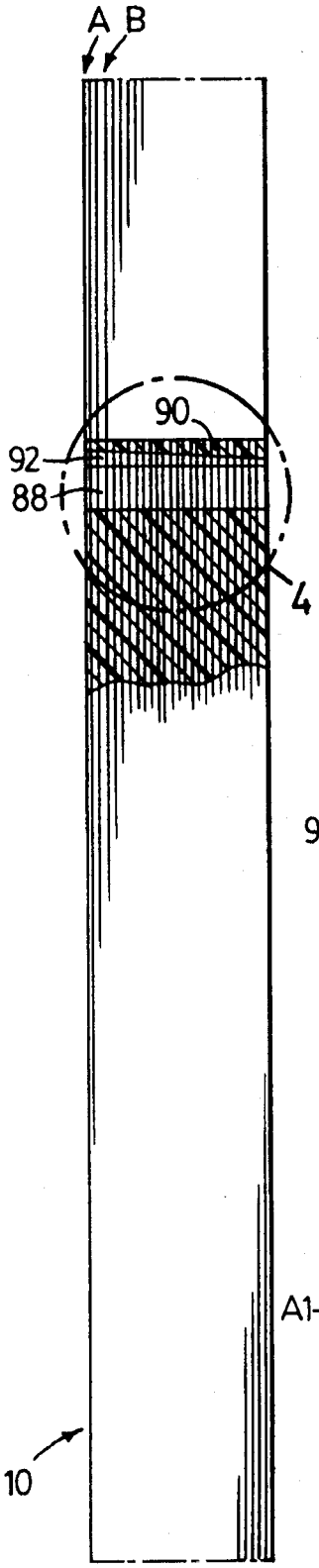
FIG. 3 is a sectional view of the bag pack of FIG. 1 along the line 3—3.

The figures show a bag dispensing system which incorporates a bag pack 10 formed by a plurality of individual bags 50 made of thin thermoplastic film stacked one on top of another in an aligned manner (as best seen in FIG. 3), and a rack 20 for supporting the bag pack.

Figure 2:
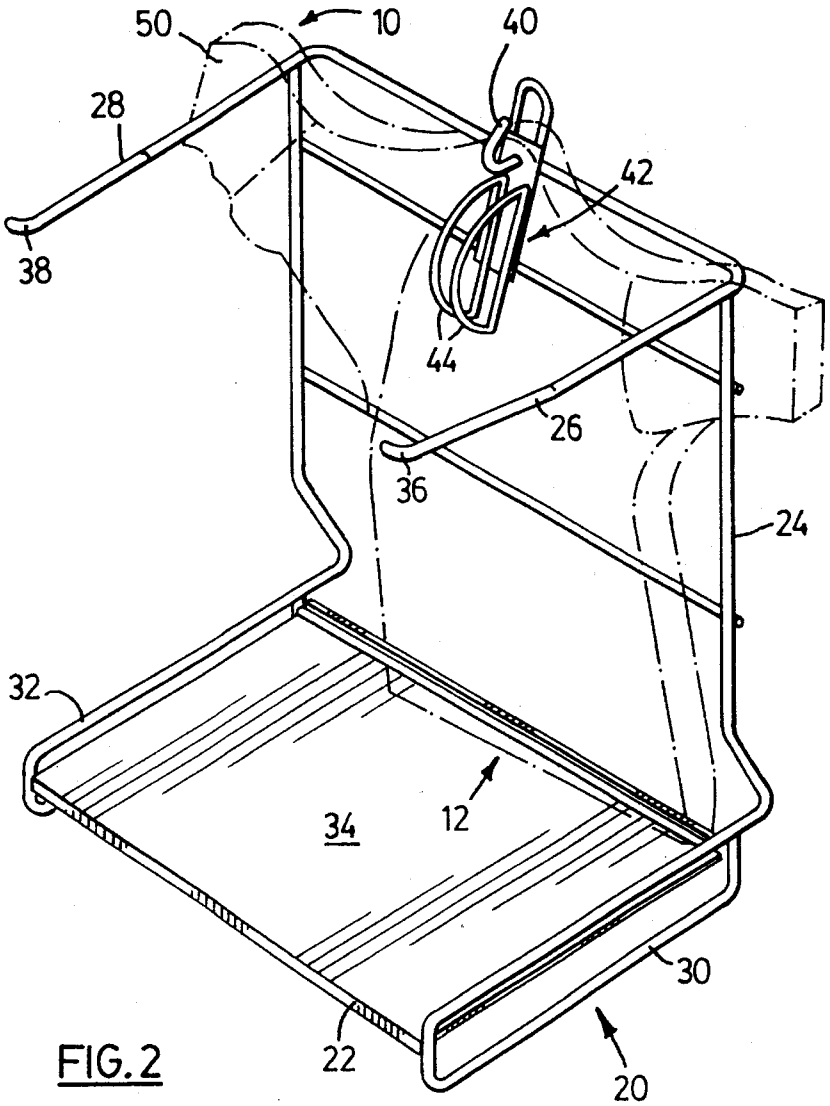
FIG. 2 is a perspective view, from the front, of a rack, according to a preferred embodiment of the present invention, supporting the bag pack of FIG. 1, shown in ghost.
Figure 7:
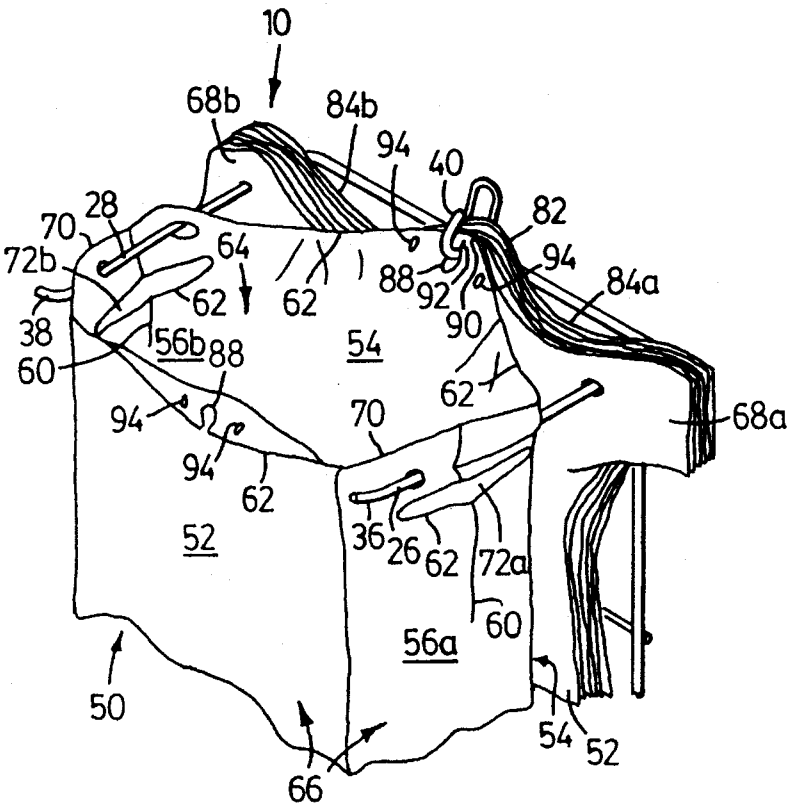
FIG. 7 is a partial perspective view similar to that of FIG. 2 showing a bag in an open position on the rack ready for loading; and, FIG. 8 is a view similar to that of FIG. 7 showing a loaded bag being removed from the rack and an adjacent bag in the bag pack being drawn partially open.

Referring first to FIG. 2, the rack 20 has a base portion 22, an upstanding frame 24 and a pair of opposed side support rods 26, 28 cantilevered from the frame 24. The base portion 22 includes opposed base frame members 30, 32, and a base plate 34 supported therebetween. The side support rods 26, 28 are spaced above the base plate 34 about the same or slightly more than the height of the bag pack 10 so that the bottom of the bag pack 10, indicated by 12, hangs just above the plate 34. The bottom 12 of the bag pack should be close enough to the base plate so that the bottom of an individual bag 50, when loaded, sits on the base plate 34 (due to some stretching of the plastic bag material) to avoid rupture of the bag material. The rods 26, 28 are each of a length to allow one bag 50 to be fully supported in an open position (as shown in FIG. 7) for loading. The tips of the side support rods 26, 28 also have upturned ends 36, 38, respectively, to prevent the open bag 50 from slipping off of the support rods during loading.

A shorter middle support finger 40 is cantilevered from the upstanding frame 24 and located between the side support rods 26, 28 for supporting an intermediate portion of the bag pack 10, as will be described below. The finger 40 should be slightly longer than the thickness of a typical bag pack 10 so that it can fit through the pack. Located below the finger 40 is a thrust support 42 to angle part of the back pack 10 away from the vertical when the pack is mounted on the rack 20. The significance of the thrust support 42 will also become apparent later. Preferably, the finger 40 and the thrust support 42 are formed as a clip on adaptor.

For ease of reference, the "front" of the rack 20 or bag pack 10 is that which is closer to the viewer in FIG. 2 (for example, the upturned ends 36, 38 are at the front of the rack), and so the "back" is that which is further from the viewer (for example, the upstanding frame 24 is at the "back" of the rack 20). Likewise, the "top" and "bottom" of the rack 20 or bag pack 10 are as shown in FIG. 2 (for example, the rods 26, 28 are at the "top" of the rack 20 whereas the base portion 22 is at the "bottom" of the rack).

Figure 1:
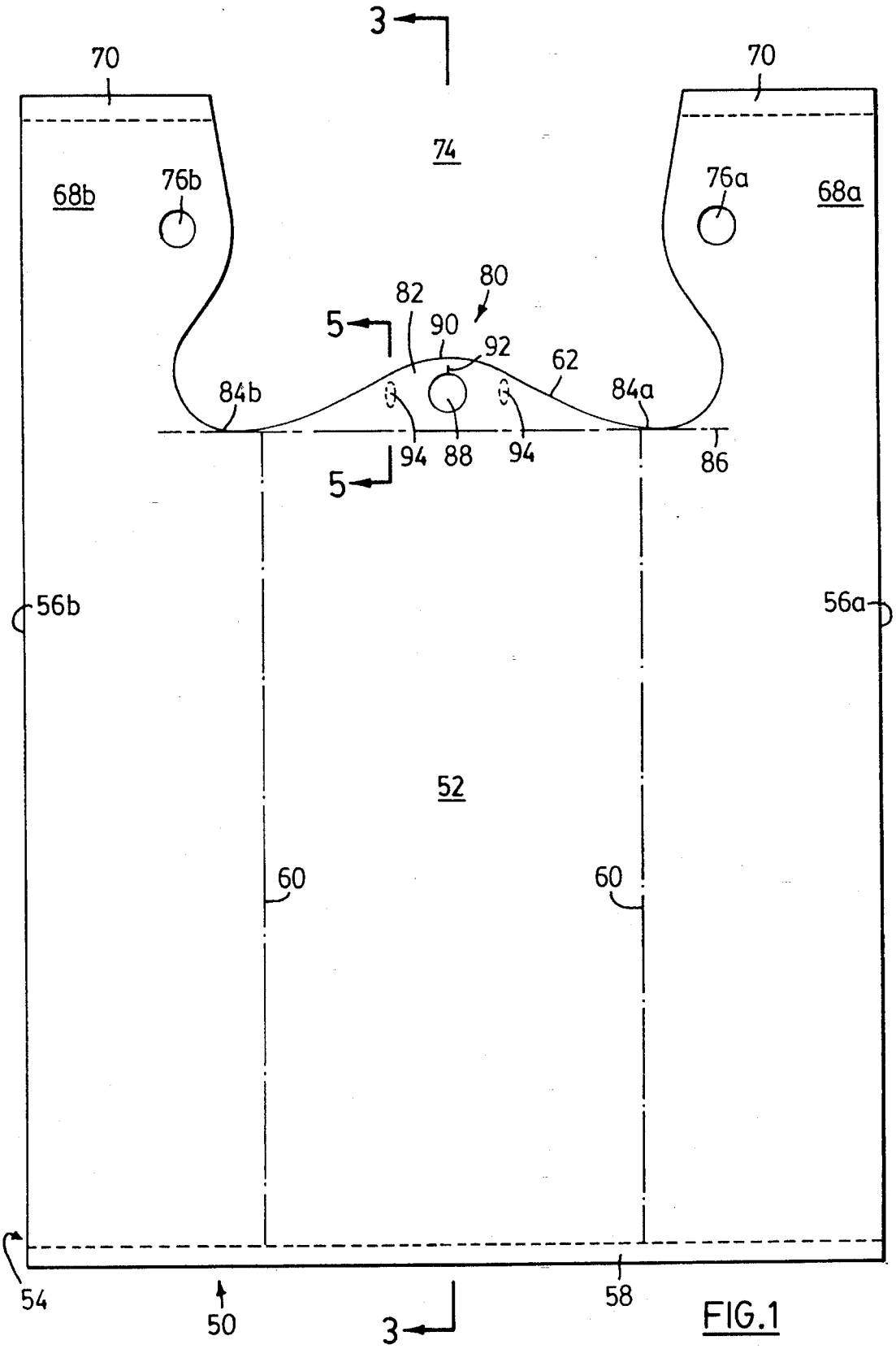
FIG. 1 is a frontal view of a bag pack according to a preferred embodiment of the present invention.

The bag pack 10, and each of the bags 50 forming the pack, will now be described in detail. Referring first to FIGS. 1 and 7, each bag 50 has a front wall 52, a back wall 54, and side walls 56*a*, 56*b* therebetween, formed integrally of a thermoplastic film. The walls 52, 54, 56*a* and 56*b* are all joined along a bottom edge 58, preferably using a hot weld process. In the FIG. 1 view, the bag 50 is shown in its flat or closed position, as part of the bag pack, with each sidewall 56*a* and 56*b* folded inwardly between the front and back walls 52, 54, the crest of the folded sidewalls being indicated by the broken lines 60. The walls 52, 54, 56*a* and 56*b* have an upper edge 62 which, when the bag 50 is an open position (as in FIG. 7), defines an open top, or mouth, to the inside of the bag. Hence, the walls 52, 54, 56*a* and 56*b* form an inside bag surface, indicated by 64, and an outside bag surface, indicated by 66, opposite the inside bag surface. A pair of opposed handles 68*a*, 68*b* extend upwardly from opposed sides of the open mouth. Each handle 68*a*, 68*b* is joined along a top edge 70 of the bag, preferably by a hot weld method, to form a closed loop for lifting the bag. The closed loop handles 68*a*, 68*b* form openings 72*a*, 72*b*, respectively, which are grasped by a user to carry the bag 50 (see FIG. 8, for example).

It will be appreciated by those skilled in the art that the handles 68*a*, 68*b* are usually manufactured integrally with the rest of the bag 50 from a continuous tube of thermoplastic material to make numerous bags one after another. The process generally comprises: (1) flattening the tube while folding two radially opposed sides to form the folds 60; (2) joining a leading edge of the tube using a hot weld to form the bottom edge 58; (3) joining a trailing portion of the tube using a hot weld to form a continuous top edge 70; (4) severing the top edge 70 from the rest of the tube of thermoplastic material, thereby forming an individual, sealed, rectangular shaped piece of tubing; (5) stacking a pre-set number of these rectangular shaped pieces with their top and bottom edges 70, 58 aligned to form a pack; and (6) dye cutting (or using equivalent means) a mouth opening 74 through the pack, thereby forming a pack of individual bags, each having the handles 68*a*, 68*b*. The handle openings 72*a*, 72*b* are formed automatically as long as the mouth opening 74 is cut beyond the folds 60 (i.e. it is cut into the folded portions of the side walls 56*a*, 56*b*).

In the preferred version of the present invention, each handle 68*a* and 68*b* has apertures or openings 76*a*, 76*b*, respectively, for receiving a respective side support rod 26, 28. The handle apertures 76*a*, 76*b* may be formed at the same time as the bag pack production step (6) above by dye cutting through a stack of handles in a pack. The dye cut is made perpendicular to the flat outside surface 66 of each handle 68*a*, 68*b*—i.e. transverse to the closed loop forming each handle. The apertures are formed without any flaps so that the cut out flap material may be reintroduced into the molten plastic material for forming the tube of thermoplastic material. These "flap-less" bags 50 are more environmentally friendly then prior art bags with flaps because there are no flaps to be discarded as trash after the bag pack 10 is used up. The dye cut flaps from the bag pack 10 may also be reused immediately at the bag production site, to reduce the amount of new plastic material required for producing subsequent bags.

An important feature of the present invention is a tear away release means, generally indicated at 80. The release means includes raised portion 82 extending from the front and back walls 52, 54. The raised portion 82 forms a crest in between two troughs 84*a*, 84*b* along the edge 62. The raised portion 82 may generally be considered as that part of the side walls 56*a*, 56*b* which extends above a straight line 86 drawn between the troughs 84*a*, 84*b*, as shown in FIG. 1.

Figure 4:
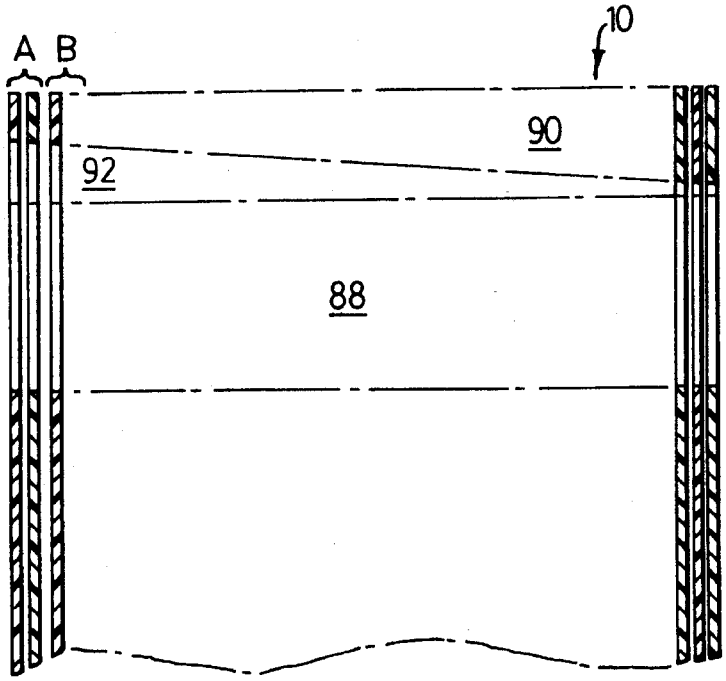
FIG. 4 is an enlarged view of the circled portion in FIG. 3.

An aperture or opening 88 for receiving the middle support finger 40 of the rack 20 is cut through the bag pack 10 in the raised portion 82, as shown in FIGS. 1, 3 and 4. The finger receiving aperture 88 is separated from the upper edge 62 of the raised portion 82 by a tear through portion 90. The tear through portion 90 is that area of the raised portion 82 which is torn or severed by the finger 40 when a bag 50 is being removed from the bag pack and from the rack, as discussed below. The aperture 88 also includes a tear promoting means to encourage a tear through the tear portion 90 when the upper edge 62 is tensioned or stretched. Preferably the tear promoting means is in the form of a cut 92 extending from the perimeter of the aperture 88 toward the upper edge 62. The cut 92 extends closer to the upper edge at the front of the bag pack 10 than at the back of the bag pack. Hence, the raised portions 82 at the front of the bag pack 10 are more easily severed from the finger 40 than those at the back of the pack. This avoids premature severance of the tear through portions 90 further back in the pack as the pack is being used on the rack.

Similar results might be achieved by replacing the cut 92 with a circular aperture 88 of variable diameter through the raised portions 82, or the like.

Figure 1A:
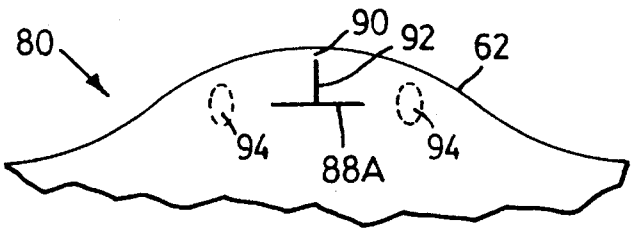
FIG. 1A shows another embodiment of a support finger receiving opening of the bag pack of FIG. 1.

Also, in an alternate embodiment shown in FIG. 1A, the opening may be in the form of a slit 88A. The slit 88A and the cut 92 (which extends from the perimeter of the slit to the portion 90) form an inverted "T" for receiving the middle support finger 40. This configuration may be easier to manufacture than the aperture 88 of FIG. 1.

Figure 5:
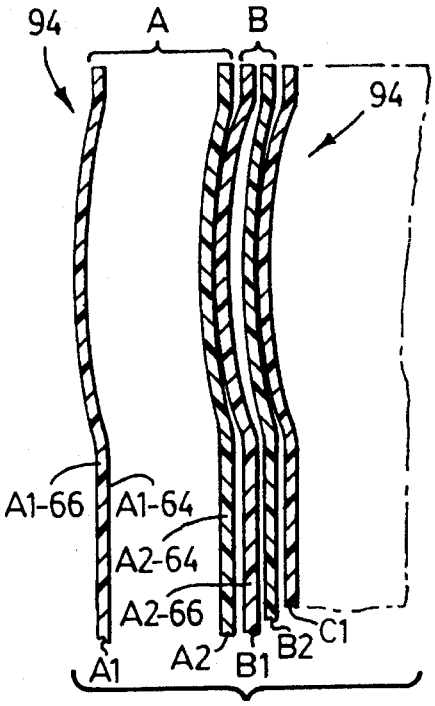
FIG. 5 is a sectional view of an upper region of the bag pack of FIG. 1 along the line 5—5 showing a cold weld through the bag pack and a front wall of a first bag in the bag pack separated from a back wall of the first bag and the rest of the bag pack.

The tear away release means 80 further includes at least one pressure point 94 located adjacent the upper edge 62 but below the tear through portion 90, for reasons which will become apparent below. In the preferred embodiment, there are two pressure points 94, one on either side of the aperture 88, formed through the pack by pressure plates or the like. The pressure points form areas of stretched material (shown in FIGS. 5 and 6) which mechanically interlock (i.e. physically interleave or join) the numerous bag wall layers in the raised portion 82 without added adhesive, chemical bonding, or the like. A weak, or adhesive-free, bond forms when the pressure plate is removed from the pack and the stretched plastic material contracts somewhat.

Each pressure point 94 is more resistive to tensile forces in the plane of the bag wall or edge (i.e. shear forces) than to forces normal (i.e. perpendicular) to the walls 52, 54 which promote peeling between successive bag surfaces. Each pressure point is also shaped as an oval and oriented on the raised portion 82 to enhance the pressure point's resistance to shear forces between bag surfaces and to help avoid its premature separation or peeling. In the preferred embodiment, the pressure point's longer axis is oriented top to bottom (i.e. extending toward the upper edge 62), and therefore its shorter axis is oriented generally transverse to the longitudinal axis. The operation of the pressure points is further elaborated below. Good results have been achieved with pressure points formed by pressure plates exerting a force of about 5,600 to 3,750 lbs. The preferred method of forming the bags is to die cut the top edge of the bags, which are stacked in packs of between 50 to 100 bags, to form the open top, handles and pressure points. Thus, some of the force is used to cut the edge of the stack of bags, and some is used to form the pressure points. Satisfactory results have been achieved by two pressure points having an oval area with a long axis of ⅜ in. and a short axis of 1/16 in. Preferably, the die cutting equipment is easily adjustable to vary the pressure applied on the pressure points, so adjustments can be made to achieve the weak bond of the present invention.

The raised portion 82 is made as flat as possible (relative to line 86) in order to promote the direct transfer of tensile forces from the bag handles 68*a*, 68*b* of a loaded bag to the tear through portion 90 on the back wall 52 of the loaded bag. One limitation on how flat the portion 82 can be made is that the aperture 88 remain above the line 86 between the troughs 84*a*, 84*b*. If the aperture 88 were placed below the line 86, the side walls 56*a*, 56*b* would be prone to longitudinal tears propagating from the aperture 88 upon the bag 50 being loaded with groceries and carried away. Consideration must also be given to the minimum length of the tear through portion 90 to provide the required tear resistance. The rounded shape of the raised portion 82 along the upper edge 62 also conserves on use of plastic material.

Before illustrating the operation of the present bag dispensing system, it can be appreciated from the foregoing discussion that the bag pack 10 has successive overlying layers of thermoplastic film. Referring to FIGS. 3–6, a first bag 50 on the front of the bag pack 10 is denoted by the reference numeral "A" and a second bag 50 adjacent and behind the first bag by "B". First bag A has a front wall 52 denoted as "A1" and a back wall 54 denoted as "A2", and the second bag has a front wall 52 denoted as "B1" and a back wall 54 denoted as "B2", and so the bag pack 10 may be thought of as having successive overlying layers A1, A2, B1, B2, and so on. Furthermore, each bag pack layer has an outside bag surface 66 and an inside bag surface 64; for example, layer A1 has an outside bag surface A1-66 and an inside bag surface A1-64, and layer A2 has an inside bag surface A2-64 and an outside bag surface A2-66. Hence, the bag pack layers A1, A2, B1, B2, etc. form successive outside to outside bag surface contacts which alternate with inside to inside bag surface contacts.

It will be appreciated that many types of thermoplastic film may be suitable for use in this invention. Satisfactory results have been obtained by a mixture of high density polyethylene together with low density polyethylene which are mixed together in the raw plastic form and extruded (blown) as a thin film 0.3 to 1.0 thousands of an inch thick, with the most preferred thickness being 0.5 to 0.7 mils.

An important feature of the present invention is that the bag pack layers be weakly joined together and that these weak joints be of alternating strengths. The weak joints are enhanced by the cling between the plastic material layers without the use of adhesives. In particular, the weak joint between the outside to outside bag surfaces should be stronger than the weak joint between the inside to inside bag surfaces. To illustrate, the outside bag surface A2-66 to outside bag surface B1-66 weak joint will be stronger than either the inside bag surface A1-64 to inside bag surface A2-64 weak joint or the inside bag surface B1-64 to inside bag surface B2-64 weak joint. These weak bonds or joints are desirable because they hold the layers of the bag pack together and in alignment, and they improve the operation of the bag dispensing system, as discussed later.

These weak bonds or joints are formed during the production process of each bag 50. It will be appreciated that a slight residue naturally accumulates on the inside and outside surfaces of the continuous tube of thermoplastic material during its formation. Although this residue tends to act as a release agent, there is still a tendency for the thin layers of a bag pack formed from this material to cling together when stacked together into a pack. Hence, weak joints of uniform strength would be formed between the layers of the bag pack. To achieve weak joints of alternating strength, however, the inside and outside bag surfaces must be treated differently. For example, each inside bag surface 64 could be over treated with a releasing agent, such as a fine powder or a further thin film of liquid, and each outside surface 66 could be left untreated. This would form an inside to inside surface joint which is weaker than the joint between outside to outside surfaces.

In the present invention, the outside bag surface 66 is treated and the inside surface 64 is left untreated to achieve an outside to outside surface joint which is stronger than an inside to inside surface joint. With reference to the production process of each bag 50 discussed earlier, good results have been achieved by treating the outside surface of the continuous tube of thermoplastic material for printing by applying an electrostatic charge to the surface 66 using a dielectric. While the primary purpose of the charge is to prepare it for inking to form a logo, a slogan, or the like, it is believed the charge removes, or "cleans" some of the naturally occurring residue from the surface 66. A charge level of about between 10 to 100 dynes has achieved satisfactory results, with 30 to 70 dynes being more preferred. It will be appreciated that the exact optimum charge will depend upon the type of ink used (water or solvent based), the ink layer, the thickness, the type of plastic, and its properties, together with the length of time the bag pack is stored after printing and prior to use.

It has been found that this treatment of the tube's outside surface caused the outside to outside bag surface contacts in a bag pack to cling together more strongly than the untreated inside to inside bag surface contacts. This tendency, in conjunction with the pressure points 94, yields a bag pack with weak bonds or joints of alternating strengths.

In view of the foregoing discussion, the operation of the present bag dispensing system will now be described. The user installs bag pack 10 on the rack 20 by slipping the rods 26, 28 through handle apertures 76*a*, 76*b*. The pack is slid to the upstanding frame 24, and the finger 40 is placed through the aperture 88 in the raised portion 82. The bottom of the bag pack is not tucked behind the base plate 34 to avoid interference with the weak joints between the pack's layers. The bag dispensing system is now ready for use. To place the first bag into an open position ready for loading as shown in FIG. 7, the user pinches a portion of layer A1, preferably at a point closer to the raised portion 82 than the bottom of the bag, and pulls the layer A1 forwardly. This causes the weak joint between inside bag surfaces A1-64 and A2-64 to start peeling apart while the weak joint between outer bag surfaces A2-66 and B1-66 remains intact. As the layer A1 is pulled away from the layer A2, enough tension is exerted on the raised portion 82 of layer A1 to severe the bond between layers A1 and A2 and the pressure points 94 and to tear through the tear through portion 90 of layer A1, thereby allowing the user to place the bag A into the FIG. 7 open position.

Figure 8:
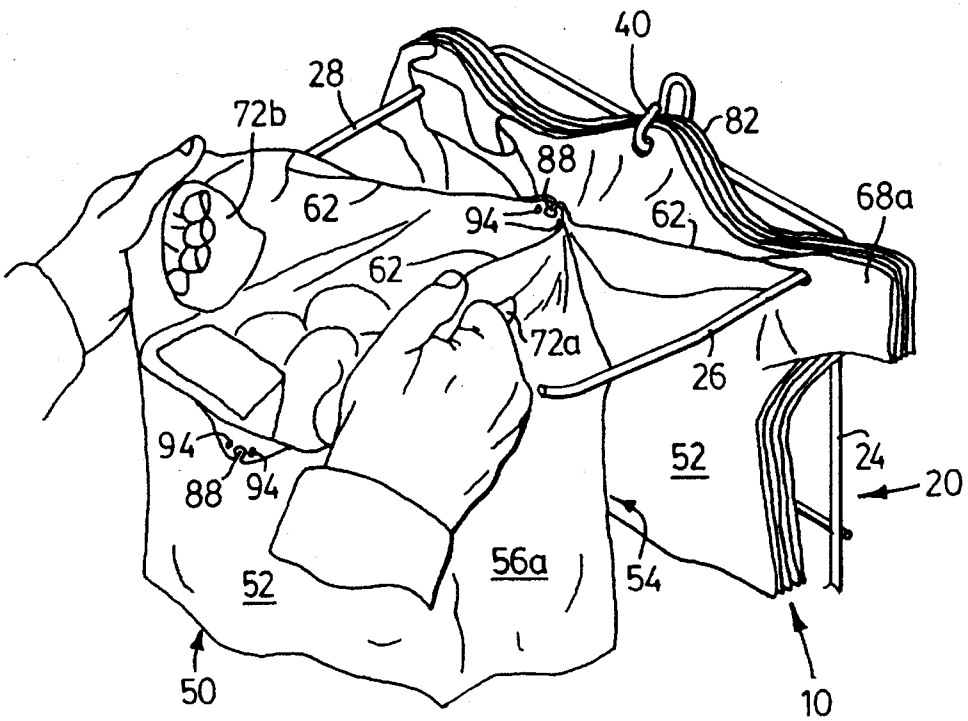

Once the bag A is filled with groceries or the like, the user grabs bag A through handle openings 72*a*, 72*b* as shown in FIG. 8 (or in any other suitable manner) to remove the bag A off of the rack 20. As the handles 68*a*, 68*b* of bag A begin to slide forwardly on the rods 26, 28, the geometry of the mouth opening 74 and the incline provided by the thrust support 42 cause tensile forces to transfer from the handles along the upper edge 62 to the tear through portion 90 in layer A2. The tensile force acts simultaneously on the adjacent tear through portion 90 on layer B1 as a result of its transfer in shear across the interface from layer A2 to layer B1. The shear transfer is accomplished by the shear resistance provided by the pressure points 94 and the cling, or weak bond, between the layers A2 and B1. At this stage, the weak bonds between the pressure points and between the layers A2 and B1, in and of themselves, would likely not be capable of severing the tear through portions 90 if the geometry of the mouth opening 74 and the handles 68*a*, 68*b* caused a normal (i.e. tensile) force transfer between the layers A2 and B1 rather a shear force transfer. It is believed that the pressure points 94 are not severed at this stage because they are located below the upper edge 62, and in particular because any separation forces normal to the points 94 are less than the bond strength of the points 94. It can now be better appreciated why the longitudinal axis of each pressure point 94 is oriented generally transversely to the direction of the tensile forces (as mentioned above), namely to provide maximum resistive force to separation of the pressure point bond (as opposed to having the longitudinal axis parallel to the direction of the tensile forces).

Figure 6:
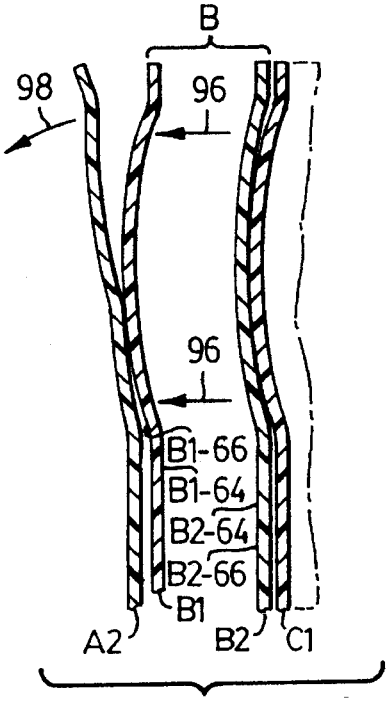
FIG. 6 is a view similar to that in FIG. 5 showing the back wall of the first bag being pulled away from the bag pack along with a front wall of an adjacent second bag.

At the same time as, or just after, the portions 90 are broken in layers A2 and B1, the relatively stronger joint between the outside bag surfaces A2-66 and B1-66 continues to remain at least partially intact in the vicinity of the raised portion 82 while the weaker joint between the inside bag surfaces B1-64 and B2-64 has peeled apart in the vicinity of the raised portion 82, as indicated by arrows 96 in FIG. 6. The bond between the pressure points 94 remains substantially intact, helping to draw the top of layer B1 forwardly into the partially open position shown in FIG. 8. As the handles of bag A continue to be pulled forwardly on the rods, the forward force exerted by the user is resisted by the tendency of the bag to cling to the bag pack. This causes the pressure points 94 to sever (as indicated by arrow 98 in FIG. 6) and the weak joint between the outside bag surfaces A2-66 and B1-66 to fully separate. With the layers B1 and B2 partially open at the top, a user may quickly and easily grab the upper edge 62 of layer B1 and draw the bag B into a fully open position ready for loading. Alternately, the user may simply stick a hand into the partially open top and push the layer B1 forwardly.

The above operation is then repeated to draw bag C open after bag B is loaded.

Unlike prior art bags, separation of a loaded bag from the bag pack does not depend upon the support rods 26, 28 having a resistive force against sliding of the next bag of the bag pack along the rods. Hence, there is no shimmying or tugging needed to overcome any resistive part of the handles, since the separation of the outside surface to outside surface weak bond is caused by the cling tendency of the bags to the bag back. Also, there is no sticky unclean adhesive to deal with. Furthermore, once the bag pack 10 is used up, there are no central tabs, aperture flaps or other pieces of plastic material left on the rack for disposal as waste. As noted earlier, the flaps from the handle apertures 76*a*, 76*b* are recycled during the manufacturing process of the bags and the raised portion 82 has been kept to a minimum profile to reduce the amount of plastic material used, in an effort to reduce the environmental costs of producing and using the bags 50.

The thrust support 42 and the arched portion 44 may now be touched upon in some more detail. In the preferred embodiment, the portion 44 is made of an outwardly curved portion (i.e. toward the front of the rack 20) to angle the upper edge 62 of the bag pack 10 away from the vertical. The support 42 makes it easier for the user to grab a front layer of the back pack to draw a bag into an open position. More importantly, however, the angling is provided for better operation of the bag pack. It helps direct the tensile forces from the handles of the bag being removed off of the rack to the tear through portion 90, and reduces the separation forces acting normal to the surface of the pressure points 94, as discussed earlier. It will be appreciated that the thrust support 42 may be made integral with the upstanding frame 24 of the rack. Alternately, the thrust support 42 and the support finger 40 may be provided on a base which is removably mounted on the frame 24, thereby allowing different racks to be adapted for use with the bag pack 10 of the present invention.

The above description is intended in an illustrative rather than a restrictive sense and variations to the specific configuration and materials described may be apparent to skilled persons in adapting the present invention to specific applications. Such variations are intended to form part of the present invention insofar as they are within the spirit and scope of the claims below. For example, the upturned ends 36, 38 of the support rods 26, 28 may be substituted with any other end which prevents the bag from sliding off the end prior to the bag being fully loaded, and if the arms are long enough to take the fully open bag may not be needed at all.

We claim:

1. A bag pack comprised of a plurality of bags weakly attached together to form a stack, each said bag comprising:

integral front, back and side walls formed from thermoplastic film, said walls being joined along a bottom edge to form a closed bottom on said bag, and said walls having an upper edge which defines an open top, said bag having an inside bag surface and an outside bag surface;

a tear away section including at least one centrally located, generally rounded support finger receiving opening having a cut edge substantially around the full perimeter of the opening which is separated from said upper edge by a tear through portion and two pressure points located closely adjacent and on either side of said opening said tear away section being configured to tear off a central support finger without leaving any thermoplastic film on said central support figure and including a slit substantially extending between said generally rounded support finger receiving opening and said upper edge of said bag, and a pair of opposed handles extending upwardly from opposed sides of said open top, each handle having a join line along a top edge and forming a closed loop for lifting said bag, each handle further including a side support rod receiving opening formed on an axis transverse to said closed loop, wherein said bag pack has successive overlying layers of thermoplastic film, forming successive outside bag surface to outside bag surface contacts alternating with inside bag surface to inside bag surface contacts, and each layer of said bag pack is weakly joined to both adjacent layers without adhesive, said weak joints between layers being of alternating strengths wherein said outside bag surface to outside bag surface weak joint is stronger than said inside bag surface to inside bag surface weak joint.

2. The bag pack of claim 1 wherein each of said support finger receiving opening includes a tear promoting means to encourage a tear through said tear through portion when said upper edge of said bag is stretched.

3. The bag pack of claim 2 wherein said support receiving opening includes a perimeter, and said tear promoting means comprises a cut in said perimeter towards said upper edge of said bag.

4. The bag pack of claim 3 wherein said bag pack includes a front and a back, and said cut extends closer to said upper edge towards said front of said bag pack than said cut extends towards the back of said bag pack.

5. The bag pack of claim 1 wherein said inner surface of said bag includes a joint weakening agent.

6. The bag pack of claim 5 wherein said joint weakening agent is a fine power.

7. The bag pack of claim 5 wherein said joint weakening agent is a thin film of a liquid.

8. The bag pack of claim 1 wherein said a pressure plate applied to said bag pack and without any added adhesive.

9. The bag pack of claim 1 wherein said pressure point is formed with a longer axis and a shorter axis, the longer axis extending generally towards the upper edge and the shorter axis being generally transverse to said longer axis, wherein said joint formed between successive surfaces of said bags in said bag packs resists forces along the upper edge of the bag while promoting peeling between said faces.

10. The bag pack of claim 9 wherein said bag pack includes two pressure points, one located on either side of said middle support finger receiving opening, and closely adjacent said upper edge of said bags but below the tear through portion.

11. The bag pack of claim 10 wherein the upper edge of the raised portion is generally rounded.

12. A bag dispensing system comprising:

a bag pack comprised of a plurality of bags weakly attached together to form a stack;

each said bag comprising;

integral front, back and side walls formed from thermoplastic film, said walls being joined along a bottom edge to form a closed bottom on said bag, and said walls having an upper edge which defines an open top, said bag having an inside bag surface and an outside bag surface;

a tear away section including at least one centrally located, generally rounded support finger receiving opening having a cut edge substantially around a full perimeter of the opening and which is separated from said upper edge by a tear through portion and two pressure points located closely adjacent and on either side of said opening said tear away section being configured to tear off a central support finger without leaving any thermoplastic film on said central support figure and including a slit substantially extending between said generally rounded support finger receiving opening and said upper edge of said bag, and a pair of opposed handles extending upwardly from opposed sides of said open top, each handle having a join line along a top edge and forming a closed loop for lifting said bag, each handle further including a side support rod receiving opening formed on an axis transverse to said closed loop, and a rack for supporting said bag pack, said rack including a pair of longer opposed cantilevered side support rods and at least one shorter cantilevered middle support finger, said cantilevered side support rods being of a length to allow one of said bags to be fully supported in an open position, and the shorter cantilevered middle support finger being of a length at least slightly longer than a thickness of said bag pack, wherein a complete bag pack can be mounted over said middle support finger at said middle support receiving opening, wherein said bag pack is in the form of successive layers characterised in that there are successive outside surface to outside surface contacts alternating with inside surface to inside surface contacts and each layer of said bag pack is weakly joined to both adjacent layers, said weak joint being characterised in alternating strengths between successive interfaces, wherein said outside bag surface to outside bag surface weak joint is stronger than said inside bag surface to inside bag surface weak joint.

13. The bag dispensing system of claim 12, wherein said rack includes a thrust support, located below said cantilevered support finger and extending outwardly beyond said cantilevered support finger for angling said upper edge of said bag pack away from vertical, when said bag pack is mounted on said rack.

14. The bag dispensing system of claim 13, wherein as said handles of a bag are being removed from said rack and are brought forward off said rack, as the tear through portion tears through, a next inwardly adjacent inside bag surface to inside bag surface weak joint begins to peel apart while the said outside bag surface to outside bag surface weak joint remains sufficiently intact to drag the next outermost bag forward to a partially open position, then the weak joint remaining between the bag being removed and the next outermost bag fully separates.

* * * * *